US007024811B1

(12) United States Patent
Cole

(10) Patent No.: US 7,024,811 B1
(45) Date of Patent: Apr. 11, 2006

(54) MAGNET PICTURE PALS

(76) Inventor: Russel Dale Cole, 26 Highland La., Chatham, IL (US) 62629

( * ) Notice: Subject to any disclaimer, the term of this patent is extended or adjusted under 35 U.S.C. 154(b) by 732 days.

(21) Appl. No.: 09/656,013

(22) Filed: Sep. 7, 2000

(51) Int. Cl.
*A47G 1/06* (2006.01)

(52) U.S. Cl. ..... 40/711; 40/778

(58) Field of Classification Search ..... 40/600, 40/661, 661.01, 711, 621, 778
See application file for complete search history.

(56) References Cited

U.S. PATENT DOCUMENTS

| | | | | | |
|---|---|---|---|---|---|
| 1,913,110 | A | * | 6/1933 | Engel | 40/778 |
| 2,068,909 | A | * | 1/1937 | Engel | 40/778 |
| 2,085,187 | A | * | 6/1937 | Engel | 40/778 |
| 3,553,873 | A | * | 1/1971 | Weston | 40/600 |
| 3,698,111 | A | * | 10/1972 | Smith | 40/600 |
| 3,965,599 | A | | 6/1976 | Ebner | |
| 4,141,162 | A | * | 2/1979 | Mascolo | 40/778 |
| 4,258,493 | A | * | 3/1981 | Kettlestrings et al. | 40/600 |
| 4,785,562 | A | * | 11/1988 | Good | 40/711 |
| 4,852,282 | A | | 8/1989 | Selman | |
| 4,912,864 | A | * | 4/1990 | Price | 40/600 |
| 4,960,258 | A | * | 10/1990 | Stocker et al. | 40/600 |
| 4,980,982 | A | * | 1/1991 | Verdon et al. | 40/661 |
| 5,050,834 | A | | 9/1991 | Tardiff | |
| 5,075,991 | A | * | 12/1991 | Wenkman et al. | 40/600 |
| 5,433,023 | A | * | 7/1995 | Edwards et al. | 40/600 |
| 6,101,752 | A | * | 8/2000 | Cumberland | 40/778 |

* cited by examiner

*Primary Examiner*—J. Hewitt
(74) *Attorney, Agent, or Firm*—Patent & Trademark Services, Inc.; Thomas Zack; Joseph H. McGlynn

(57) ABSTRACT

A holder for an object such as a photograph or a calendar. The holder may include either three or four layers. If made of three layers, there is an object engaging non-slip layer, a layer with magnetic properties that bears against the non-slip layer and an outer transparent or clear layer. A pocket formed between layers is used to receive a corner of the object to be held. This pocket is formed between the non-slip layer and the outer transparent layer. If four layers are used in the construction of the holder, then the transparent layer is folded to extend to enclose both the magnetic layer and the non-slip layer to form a corner object receiving pocket between them. All holders may have a triangular shape with an opened hypotenuse side used to receive the edge of the object to be held. At lease two such holders are normally used to retain an object, although six holders, one at each corner of the object and two at mid length, may be used to provide for greater holding strength. Variations in object dimensions may be compensated for by simply moving the movable holder corners different distances apart on the supporting metallic surface, like on a refrigerator door.

4 Claims, 2 Drawing Sheets

MAGNET PICTURE PALS

BACKGROUND OF THE INVENTION

This invention relates to a holder for a photograph or the like that uses a magnet to attract and retain the holder to a metallic surface. For many years it has become commonplace to use magnets fixed to objects to retain the object to an attractable metallic surface.

DESCRIPTION OF THE PRIOR ART

Object holders with different types of mounts have been used for some time to detachably mount the objects on supporting surfaces, such as refrigerator doors. In many cases these holders use magnets to retain and attract the holder to supporting metallic surfaces. For example, U.S. Pat. No. 3,965,599 to Egner discloses a mounting system that uses magnets to mount a picture to a metallic surface, such as on a refrigerator door U.S. Pat. No. 4,785,562 to Good discloses a mounting system which has four corners and magnets are used to mount a picture to a supporting surface such as a refrigerator door.

U.S. Pat. No. 4,852,282 to Selman discloses a mounting system used with a calendar that has a clear cover sheet and magnets to mount the calendar to a metallic surface which surface also could be a refrigerator door.

U.S. Pat. No. 4,912,864 to Price discloses a frame for mounting sheet material to a surface which support surface could also be a refrigerator door.

U.S. Pat. No. 5,050,834 to Tardiff discloses a supporting plate of clear plastic which uses magnets or adhesive to mount a picture to a surface such as a refrigerator door.

In the present invention mounting system includes at least two corner pieces with each corner piece including three layers. One layer is a magnetic material, another layer is a non-slip material and the third layer is a clear cover all as will be detailed in the specification that follows hereafter.

SUMMARY OF THE INVENTION

This invention relates to a mounting system having at least two corner pieces with each piece having three layers. One of the layers in each piece is made of magnetic material, another layer is made of non-slip material and the third layer is made of a clear or transparent material.

It is the primary object of the present invention to provide for an improved mounting system for photographs, calendars, and like objects to be displayed against a supporting surface.

Another object is to provide for such a system in which there are at least two spaced pieces that engage corners of the object to be displayed with each piece having three layers of material including a magnetic layer, a non-slip layer and a clear cover layer.

An additional object of the present invention is to use the same to mount objects with different width and height dimensions by spacing the holding corner pieces at different distances apart to accommodate the different sized objects.

These and other objects and advantages of the present invention will become apparent to readers from a consideration of the ensuing description and the accompanying drawings.

BRIEF DESCRIPTION OF THE DRAWINGS

FIG. 3 (*b*) is a side cross sectional view showing one of the two mid holders of FIG. 3 (*a*) engaging an edge of an object.

DESCRIPTION OF THE PREFERRED EMBODIMENT

Figure 1:
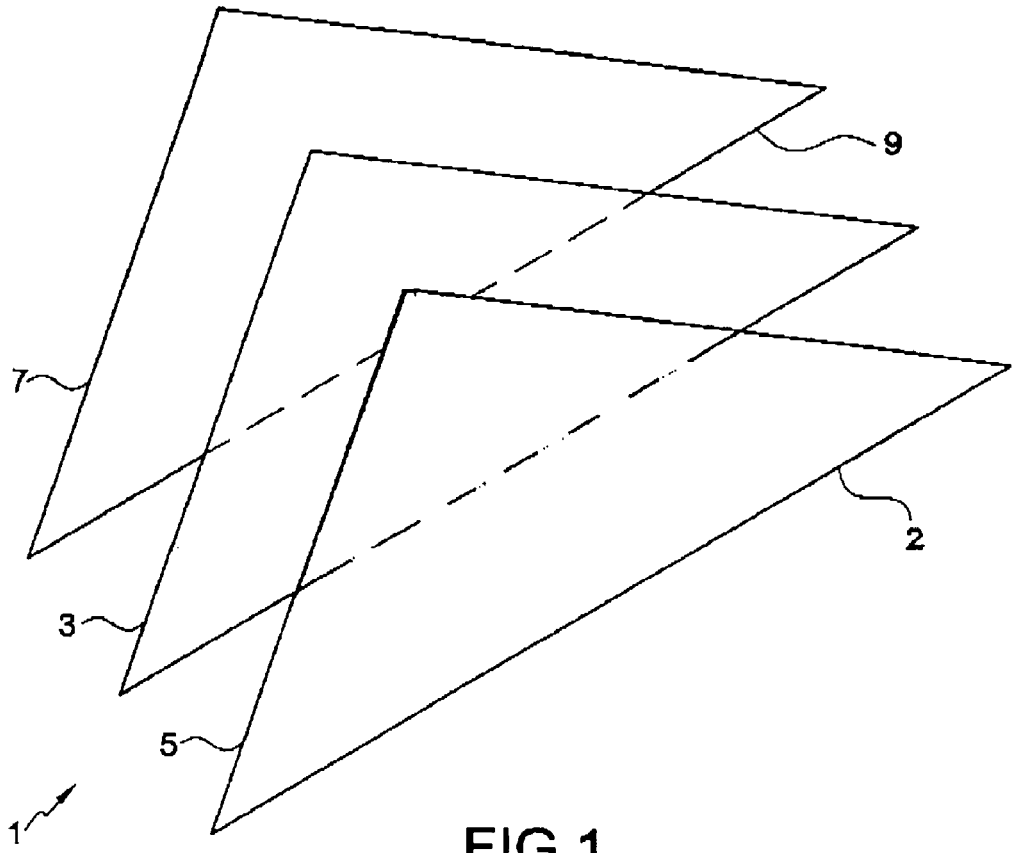
FIG. 1 is a perspective front view of the present invention.

FIG. 1 is a perspective front view of the present holder invention 1. Three distinct planar layers are used to make the holder. All of the layers may be shaped like a right triangle. One material layer 3 that directly engages the back surface of the object to be held, like a corner of a rectangular shaped photograph, is made of non-slip material like a foam or foam rubber or the like. Fixed or otherwise held to the layer 3 is a second layer 5, similarly shaped, made substantially of a magnetic material. The third holder layer 7 is also triangularly shaped like a pocket with the hypotenuse side 9 opened to receive the right angle corner of the planar object to be held. Layer 7 may be a clear or transparent plastic material. Transparent layer 7 may consist of a single layer bonded at two of its edges to the similarly shaped and sized layer 5 with an opened hypotenuse edge, as shown in FIG. 1.

Figure 2:
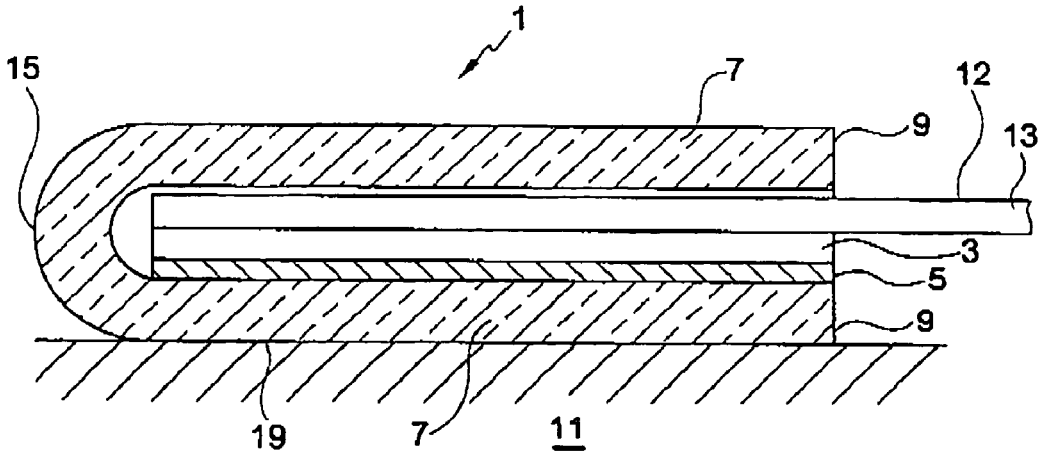
FIG. 2 is a side cross sectional view similar to the FIG. 1 holder showing the holder mounted to a supporting surface with a corner of a photograph inserted in the holder.

Alternately, layer 7 may consist of two parallel identically sized folded layers with the same shape and size having joining corner edges used to form an opened pocket, as shown in FIG. 2. The layer 5 with the magnetic material may have the same shape and size as the layer 3 or may be a different smaller surface size as long as it provides sufficient holding power for the holder on the supporting for the retained object. If two layers are used to construct the pocket layer 7, one of these layers—the bottom layer—may be below the magnetic layer 5 and thereby act to help retain the magnet layer within the pocket layer as well as the non-slip layer 3.

FIG. 2 is a side cross sectional view similar to the FIG. 1 holder showing the holder 1 mounted against the flat supporting surface 11 with a corner of a photograph 13, object to be held, inserted in the holder. In this embodiment of the invention, the outer transparent layer 7 is also triangular shaped but consists of two parallel layers joined at their respective non-hypotenuse side edges 15 to each other with an opened space between their two hypotenuse sides 9.

Inserted within the space between the side edges 9 is one of the right angled corners of the object 13. The top surface 17 of object 13 bears directly against the outer exposed layer of pocket 7 while the lower surface of object 13 bears the the non-slip surface 3 which directly contacts the magnetic material layer S. Layer 5 bears against the top surface of the lower layer 7 and it and the layer 3 are within the pocket formed by the two layers 7.

As stated before, the magnetic layer 5 may have the same shape as the non-slip layer 3 located against its upper side or may have any desired shaped within the confines of the pocket as long as it performs to hold both the holder and the supported object corner to the supporting magnetically attractable support surface 11, like the flat surface of a refrigerator. The layer 5 could, for example, be formed by spaced small magnets or magnetic materials spread along and lower surface of object engaging layer 3.

At least two corners of support object are usually engaged by two different and identical holders 1 to retain the object in a level supported position, however, in many cases four such holders are used with one holding each of the four corners of the object. For example, if the planar object 13 to be retained was a rectangular shaped photograph or calendar, then each of four corners would be engaged by a separate holder spaced along the supporting surface. The spacing between holders is determined by the dimensions of the planar object to be held. Clearly, the same four corner holders can be used to retain objects with different dimensions, heights and lengths, thereby providing for greater versatility in use as contrasted to an object holding member whose corners are fixed relative to each other.

Figure 3:
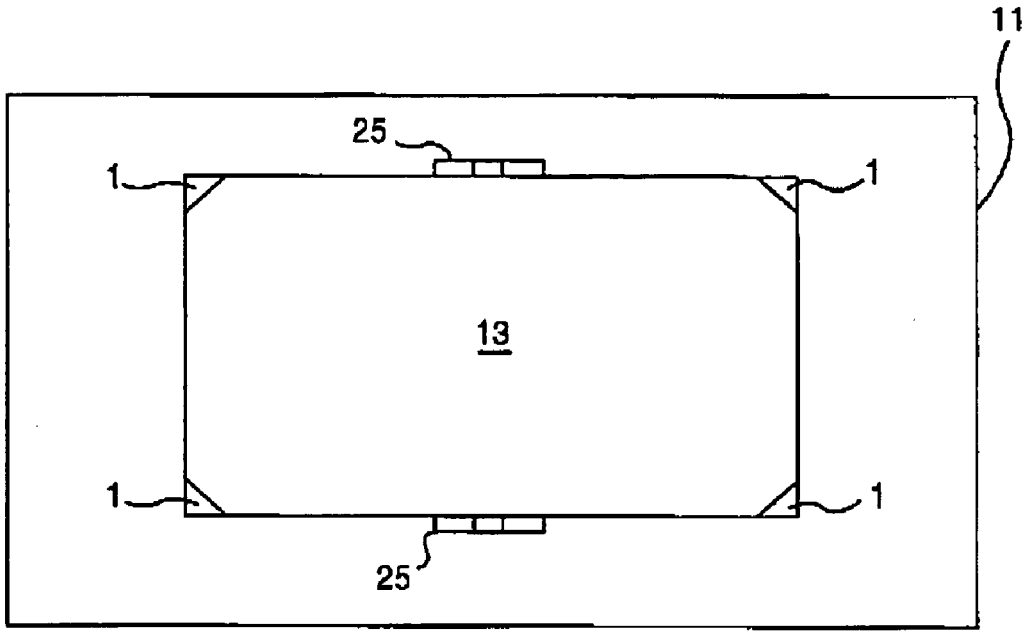
FIG. 3 (*a*) is a front view showing four holders mounted on the four corners of a typical object with two mid holders placed against the supporting surface of a refrigerator door.
Figure 3:
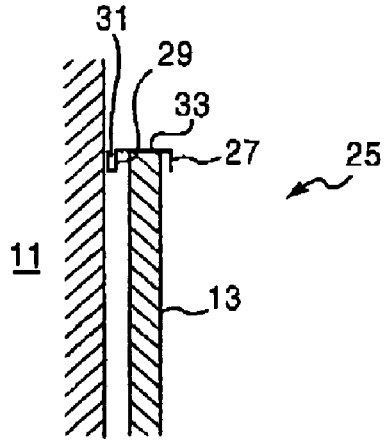

FIG. 3 (*a*) is a front view showing four separate corner mounted holders 1 with two mid holders 25. All six holders are placed against the supporting surface of a refrigerator door. In this particular use, the top freezer door is the supporting flat metallic surface 11 for the four spaced holders 1 and the two mid holders 25. Each corner holder is configured as in FIG. 1 or FIG. 2 and retains one of the four corners of an object, like a photograph or calendar 13.

In fact any object with the necessary sized holder engaging corners may be so retained against the flat supporting surface. Either the single layer embodiment of the transparent layer 7 (FIG. 1) or the dual layer embodiment (FIG. 2) may be used for the holders. Each embodiment provides a formed corner pocket for the respective corners of the object to be held. If it is desired to remove the displayed object and insert another in its place, the holders can be simply detached from the supporting support 11 and positioned to engage the corners of the new object to be retained. In this embodiment the supporting surface 11 is the front flat top freezer door of a refrigerator.

FIG. 3 (*b*) is a side cross sectional view showing one of the two identical mid holders of FIG. 3 (*a*) engaging an edge of the object 13. Each mid holder 25 may consist of three layers as in FIG. 1. The outer layer 27 is a transparent layer with the edge of the object 13 to be held positioned between that layer and the non-slip layer 29. A single backing member 33 along with parallel layers 27 and 29 forms an opened pocket to receive the edge of the object, like a photograph. Backing 33 extends to where layer 31 joins it perpendicularly. Layer 31 has magnetic materials to attach the holder 25 to the supporting freezer door surface 11. Clearly the holder 25 may be used along any of the straight outer edges of the object to retain it to the supporting surface 11. More than two such holders 25 may be used as desired.

If desired the corner holders 1 may be made of non-transparent material and of different colors and designs. For non-metallic support surfaces 11, adhesive backing surfaces could be used in place of the magnetic layers 5. Almost any planar object with engageable corners can be displayed using the holders disclosed.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What is claimed is:

1. The combination of a holder and an object with corner edges comprising:

a holder having at least three distinct material layers, said holder comprising a corner pocket to engage a corner edge of the object to be held, the first layer of said at least three distinct layers having a non-slip surface to engage and bear against a corner surface of the object to be held, the second layer of said at least three distinct layers having magnetic material, the third of said at least three distinct layers consisting of a transparent material to shaped to form the corner pocket; and an object having corner edges to complement the size and shape of the corner pocket formed.

2. The combination of a holder and an object with corner edges as claimed in claim 1 wherein said combination comprises at least two substantially identical holders, said two substantially identical holders being spaced from each other and adapted to receive a different corner of the object to be held.

3. A holder for an object and a supporting surface for the holder comprising:

a holder having three layers, said holder comprising a corner pocket for the corner edge of the object to be held, a supporting surface for the holder, the first layer of said three layers having a non-slip surface to engage and bear against a surface of the object to be held, the second layer of said three layers having magnetic material, the third layer of said three layers consisting of a transparent material layer to form with said first layer the object receiving pocket between the third layer and the first layer, and said second layer being directly against and held to the supporting surface by the magnetic material.

4. The holder for an object and a supporting surface for the holder as claimed in claim 3, wherein the second layer with magnetic material is fixed to the first layer.

* * * * *